US006327792B1

(12) United States Patent
Hebert

(10) Patent No.: US 6,327,792 B1
(45) Date of Patent: Dec. 11, 2001

(54) PORTABLE AND COLLAPSIBLE SPORTS DRYER

(76) Inventor: Donald L. Hebert, 309 Burr Oak Dr., Albert Lea, MN (US) 56007

( * ) Notice: Subject to any disclaimer, the term of this patent is extended or adjusted under 35 U.S.C. 154(b) by 0 days.

(21) Appl. No.: 09/525,324

(22) Filed: Mar. 13, 2000

(51) Int. Cl.[7] ..... F26B 25/00
(52) U.S. Cl. ..... 34/104; 34/107
(58) Field of Search ..... 34/103, 104, 105, 34/106, 107

(56) References Cited

U.S. PATENT DOCUMENTS

| | | | | |
|---|---|---|---|---|
| 3,513,564 | | 5/1970 | Gramprie . | |
| 3,645,009 | | 2/1972 | Ketchum . | |
| 3,798,788 | | 3/1974 | Kuntz . | |
| 4,136,464 | | 1/1979 | Hay . | |
| 4,145,602 | | 3/1979 | Lee . | |
| 4,171,580 | | 10/1979 | Vabrinskas . | |
| 4,570,358 | * | 2/1986 | Sacerdote | 34/107 |
| 5,222,308 | | 6/1993 | Barker et al. . | |
| 5,289,642 | * | 3/1994 | Sloan | 34/104 |
| 5,592,750 | * | 1/1997 | Eichten | 34/104 |
| 5,819,433 | | 10/1998 | Crooks . | |
| 5,930,913 | * | 8/1999 | Liao et al. | 34/104 |

* cited by examiner

*Primary Examiner*—Gregory Wilson
(74) *Attorney, Agent, or Firm*—James V Harmon

(57) ABSTRACT

A portable and collapsible sports dryer for drying wearing apparel has at least one rigid air supply tube with an open end for being placed within a clothing article for supporting it above the dryer. An electric blower communicates with the tube for circulating air to dry the clothing article, and a removable drip shield is provided between the open end of the tube and the electric blower for deflecting moisture that drips from the clothing article away from the electric blower. A carrying case containing the air blower serves as a supporting base for the dryer when the dryer is placed on the floor or on a table. The air supply tube is adapted to be stored in a storage plenum within the case and is removed and then connected during use to the blower. The tube is positioned while in operation to extend upwardly from the case for forcing a current of air through an article of wearing apparel supported upon an upper free end of the rigid air supply tube.

20 Claims, 3 Drawing Sheets

PORTABLE AND COLLAPSIBLE SPORTS DRYER

FIELD OF THE INVENTION

This invention relates to dryers and particularly to a portable dryer for clothing articles.

BACKGROUND OF THE INVENTION

While a variety of dryers have been proposed for drying shoes, boots, mittens and the like, few have been suitable for taking on a camping trip or other sporting events where travel is required. To be acceptable for the purpose of hunting and fishing trips, the device must be self-contained, easy to carry, compact and yet large enough when in use to support various articles of clothing including mittens, shoes and boots as well as relatively large, heavy or bulky articles such as chest waders which may be four or five feet in height. In addition, an electric motor used for operating an air blower must be protected from moisture that may drip from the clothing and run into the operating mechanism which could, if it occurred, either short out the wiring or motor or increase the moisture content of the drying air.

In view of these and other deficiencies of the prior art, it is one object of the present invention to provide a sport dryer of the type described which is portable, self-contained, enclosed and easily carried.

Another object of the invention is to provide a sports dryer that can be carried as a compact unit but is still capable of supporting relatively large, bulky or heavy clothing articles such as a chest wader or large boots in an inverted position three or four feet or more above the base of the unit.

Yet another object is to provide a compact sports dryer having a dual purpose carrying case which, besides functioning as a storage enclosure, also provides a supporting base which includes a way of distributing drying air.

A further object is to provide a sports dryer of the type described which is well suited for mass production, is reliable in operation, rugged in construction and has elongated air supply tubes that can be stowed in a compact, easily carried bundle when not in use.

These and other more detailed and specific objects of the present invention will be better understood by reference to the following figures and detailed description which illustrate by way of example of but a few of the various forms of the invention within the scope of the appended claims.

SUMMARY OF THE INVENTION

A portable and collapsible sports dryer for drying wearing apparel has at least one rigid air supply tube with an open end for being placed within a clothing article for supporting it above the dryer. An electric blower communicates with the tube for circulating air to dry the clothing article, and a removable drip shield is provided between the open end of the tube and the electric blower for deflecting moisture that drips from the clothing article away from the electric blower. A carrying case containing the air blower serves as a supporting base for the dryer when the dryer is placed on the floor or on a table. The air supply tube is adapted to be stored in a storage plenum within the case and is removed and then connected during use to the blower. The tube is positioned while in operation to extend upwardly from the case for forcing a current of air through an article of wearing apparel supported upon an upper free end of the rigid air supply tube.

THE FIGURES

DETAILED DESCRIPTION OF THE INVENTION

Figure 1:
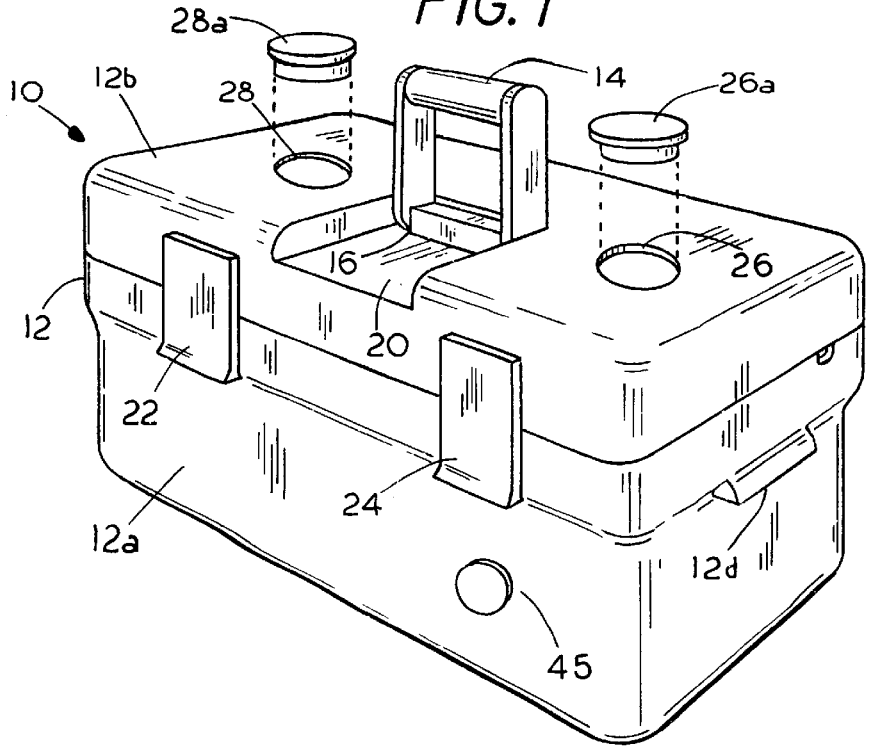
FIG. 1 is a perspective view of the invention as it appears before use as when being carried from one location to another.
Figure 2:
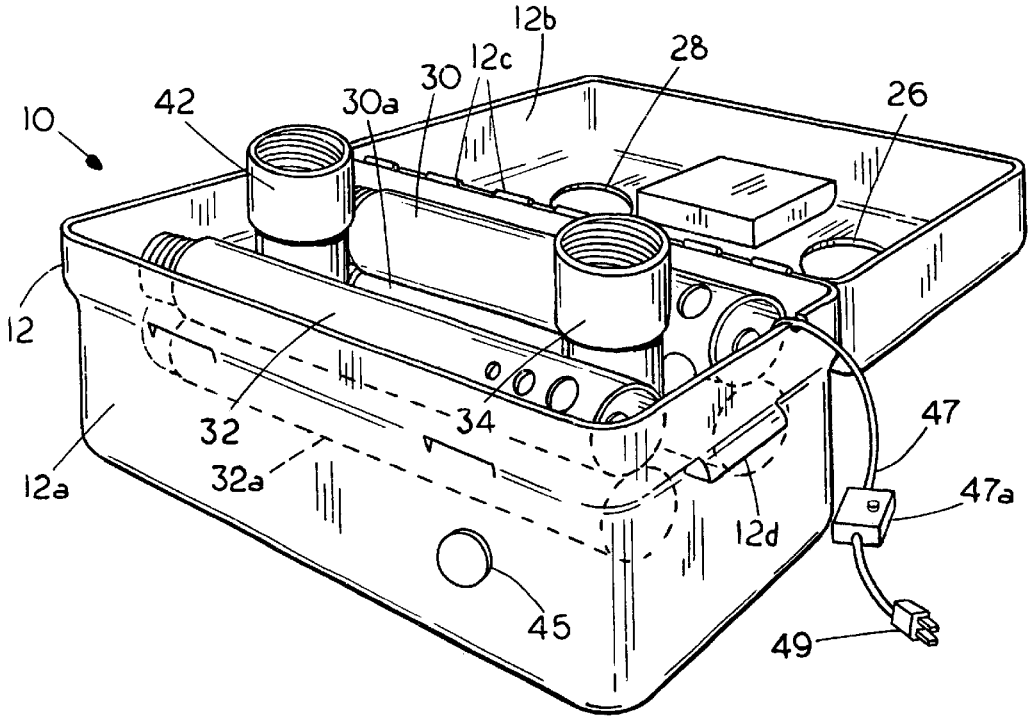
FIG. 2 is a view similar to FIG. 1 with the cover shown in an open position.

A sports dryer according to the invention is indicated generally by the numeral 10. As shown in FIGS. 1 and 2, the dryer includes a case or housing 12 which can be formed from metal or plastic and having a hollow base portion 12*a* and a removable cover or drip shield 12*b* that is connected to the base 12*a* by means of a hinge 12*c*. Boots, shoes and waders are often partially filled with water before being dried. The cover or drip shield 12*b* serves to deflect and carry away any water that runs out of the articles being dried. Thus, the drip shield 12*b* is useful in preventing moisture from entering the dryer 10 and causing possible damage to electrical components such as wiring or an electric motor M within the case 12. The carrying case 12 serves as a supporting base for the dryer 10 when its lower surface is placed on the floor or on a table. The base portion 12*a* can also be provided with built-in carrying handles such as 12*d* at each end, if desired.

Figure 4:
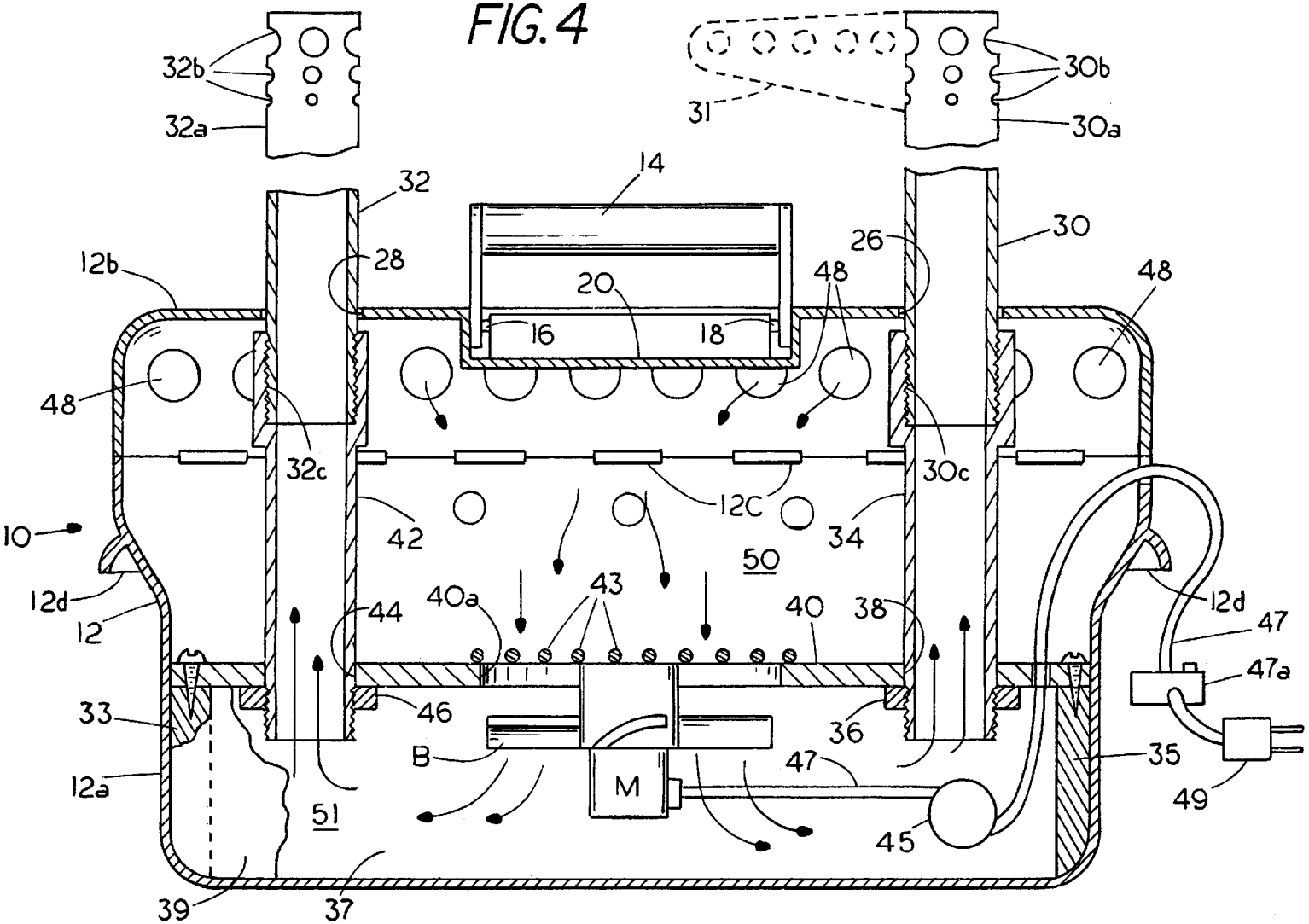
FIG. 4 is a vertical longitudinal sectional view taken on line 4—4 of FIG. 3 on an enlarged scale.

In the center of the cover 12*b* is provided a recess 20 in which a retractable carrying handle 14 is pivotally secured by means of pivots 16 and 18 (FIG. 4). The cover 12*b* can be retained in a closed position by means of latches 22, 24 of any suitable known construction. The cover 12*b* also includes a pair of circular openings 26, 28 for air supply tubes to be described below. If desired, these openings can be closed by means of removable caps such as rubber or plastic plugs 26*a*, 28*a*, respectively, when the dryer is not in use.

Figure 3:
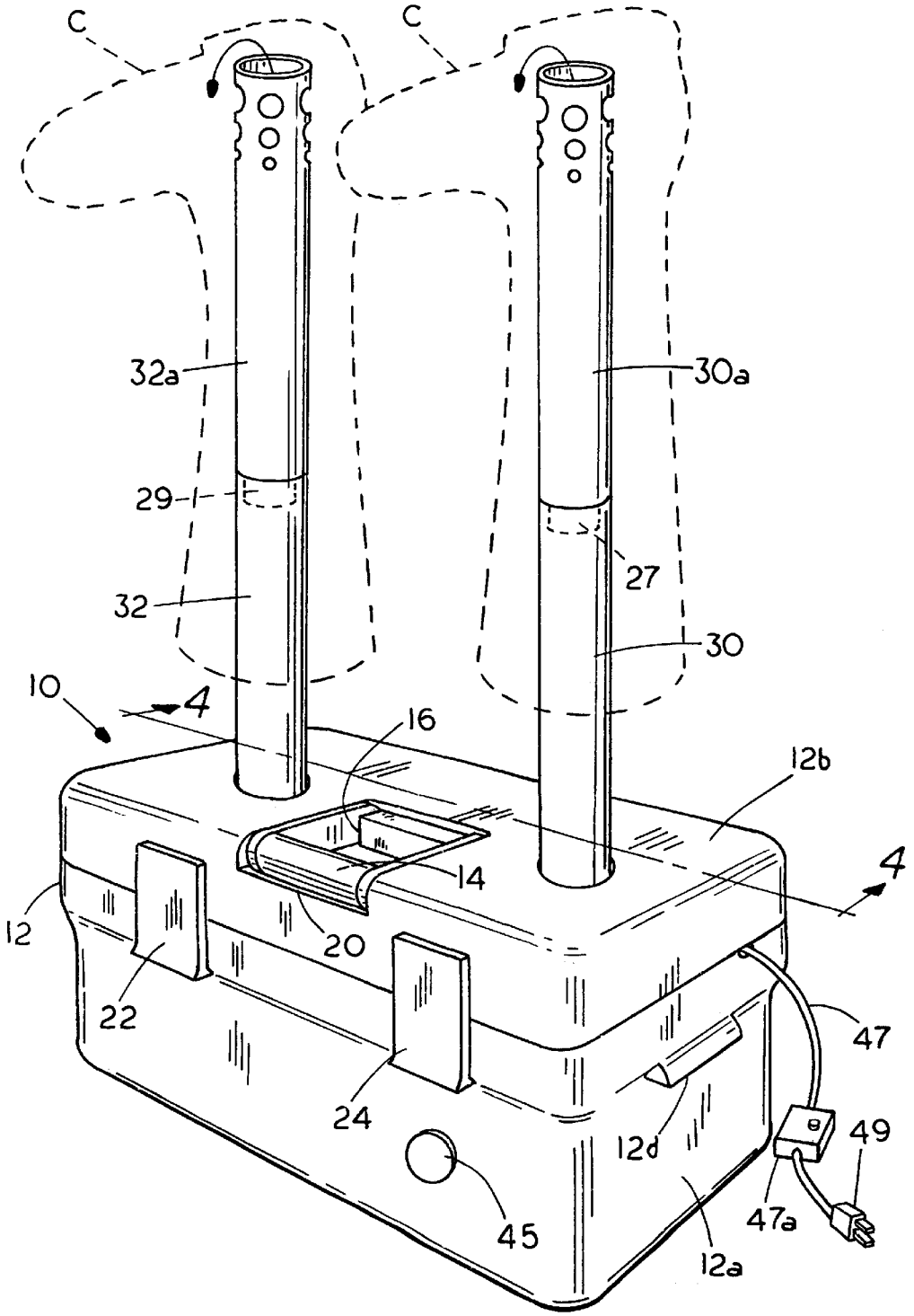
FIG. 3 is a perspective view of the invention as it appears during use.

When the dryer 10 is in operation, a pair of laterally spaced rigid dryer tubes are deployed in a vertical position as shown in FIGS. 3 and 4. One of the dryer tubes consists of two segments 30 and 30*a* which are connected together at 27 by means of screw threads, friction, a snap-fit or bayonet connection. A second dryer tube consists of segments 32 and 32*a* which are connected to each other by means of a suitable connection 29 similar to the connection 27. The upper end portions of the dryer tube segments 30*a*, 32*a* are preferably provided with multiple outlets such as bored openings 30*b* and 32*b*, respectively. The upper ends of the dryer tubes 30–32*b* can, if desired, be provided with hollow lateral extensions as shown at 31 in FIG. 4 with bored openings to provide better air circulation for drying shoes or boots if desired. Good results have been obtained by forming tubes 30–32*b* from either rigid vinyl or ABS plastic pipe 1½" in diameter and 19" in length so that the upper end of each tube is typically about 38" above the top of cover 12*b*.

When in use, the dryer tubes 30, 32 are connected, e.g. by screw threads 30*c*, 32*c*, to vertically disposed, laterally spaced pipes 34 and 42, respectively. The pipe 34 is rigidly secured, e.g. by means of a locknut 36 within an opening 38 in a horizontally disposed partition 40 within the case 12 in alignment with the opening 26. Similarly, the pipe 42 is rigidly secured, e.g. by locknut 46 within an opening 44 in the partition 40 near the opposite end of the case 12 and in alignment with the opening 28. The pipes 34, 42 remain fixed at all times in the positions shown in FIGS. 2 and 4, but the air distribution tubes 30, 30*a* and 32, 32*a* are disassembled and removed when not in use and placed in storage in a horizontal position on either side of the pipes 34, 42 as shown clearly in FIG. 2. The pipes 34 and 42 act as holders for keeping the tubes in place while in storage.

In the center of the partition 40 is a circular opening 40*a* which has a grille 43 mounted above it. Suspended below the grille 43 and in alignment with the opening 40*a* is a blower B having laterally extending fan blades as shown which are driven during use by means of an electric motor M. The motor M is connected via conductors or cord 47 and an on/off switch 45 to a wall plug 49 through ground fault interrupter 47*a* of any suitable known construction. The blower and motor assembly can, for example, be a 120 volt, 0.26 amp Hoffman motor and blower assembly for a 5⅜" hole 40*a* or a 120 volt, 0.18 amp Hoffman motor and blower assembly for a 4½" hole 40*a*. The cord 47 is stored in the case 12 when not in use.

The partition 40 is secured in a horizontal position near the middle of the case 12, e.g. by means of screws on the upper edge of a rectangular framework formed from laterally extending, longitudinally spaced frame end pieces 33, 35 connected at their ends to longitudinally extending, laterally spaced apart frame members 37 and 39 (FIG. 4). All of the frame members 33, 35, 37 and 39 can be formed from suitable wood, plastic or composition material and all are attached, e.g., by being adhesively bonded to the adjacent wall of the bottom portion of the case 12*a* to form a support for the partition 40. The partition 40 thus divides the case 12 into an upper air supply plenum 50 which also serves as a tube storage compartment for the tubes 30, 30*a*, 32, 32*a* (FIG. 2) and a lower compartment 51 that functions as a manifold for distributing air via the pipes 34, 42 to the tubes 30–32*a*. Air can be admitted to the plenum 50 via bored openings 48 in the cover 12*b* (FIG. 4).

Thus, when the dryer is to be used, the cover 12*b* is opened as shown in FIG. 2 and the tubes 30, 30*a*, 32 and 32*a* are removed from the storage location within the tube storage plenum 50. The cover 12*b* is then closed and the segments of each of the tubes are assembled as shown in FIG. 3. After removing the plugs 26*a* and 28*a*, the ends of the tubes 30, 32 are passed through the openings 26, 28 and are screw-threaded into the pipes 34, 42, respectively, as shown in FIG. 4. The plug 49 is then connected to a wall socket and the switch 45 is closed so as to operate the motor M. The blower B then draws air through the openings 48 into the tube storage plenum 50, thence through the opening 40*a* into the manifold 51 from which the air passes upwardly through the pipes 34, 42 and out through the tops of the tubes 30, 30*a* and 32, 32*a*, thereby drying the articles of clothing C such as shoes, boots, mittens, chest waders, etc. which are placed in an inverted position over the upper ends of the uppermost tube segments 30*a*, 32*a* (FIG. 3). Any moisture that runs out of the boots or other articles will be kept away from the blower B, electric motor M and associated wiring by means of the drip shield 12*b* which serves as a cover. Most articles of clothing C can be dried in from about 10 minutes to an hour. After use, the segments 30, 30*a*, 32 and 32*a* of the tubes are disassembled and placed in storage as shown in FIG. 2. The cover 12*b* can then be closed and the dryer 10 can be conveniently carried by means of the retractable handle 14 to the next location where it is to be used.

Many variations of the present invention within the scope of the appended claims will be apparent to those skilled in the art once the principles described herein are understood.

What is claimed is:

1. A portable and collapsible sports dryer for drying wearing apparel, comprising:

at least one air supply tube having an open end for being placed within a clothing article, a carrying case with a compartment therein, an electric blower communicating with the tube and located within the compartment for circulating air to dry the clothing article, and a removable drip shield is provided in spaced relationship above the compartment between the open end of the tube and the electric blower for deflecting moisture that drips from the clothing article away from the compartment enclosing the electric blower therein.

2. The apparatus of claim 1 wherein the air supply tube is removable and a storage chamber is provided in the carrying case for said tube.

3. A portable and collapsible sports dryer for drying wearing apparel, comprising:

at least one air supply tube having an open end for being placed within a clothing article, an electric blower communicating with the tube for circulating air to dry the clothing article, and a removable drip shield is provided between the open end of the tube and the electric blower for deflecting moisture that drips from the clothing article away from the electric blower and, the dryer has a carrying case, the drip shield is hinged to the carrying case and includes at least two holes therethrough, and one such tube extends through each of the holes during operation.

4. The apparatus of claim 3 wherein the drip shield is a horizontal panel having a hole therein for the tube such that the tube extends during use out through the hole in the drip shield.

5. The apparatus of claim 3 wherein the drip shield comprises a top wall of a carrying case.

6. The apparatus of claim 3 wherein two such air supply tubes are provided and the dryer includes a carrying case having a storage chamber for said tubes.

7. A portable and collapsible sports dryer for drying wearing apparel, comprising:

a carrying case that serves as a supporting base for the dryer when the dryer is placed on the floor or on a table, an air blower in said case, a rigid air supply tube adapted to be stored within the case and connected during use in communication with the blower, said tube being positioned while in operation to extend upwardly from the case for forcing a current of air through an article of wearing apparel supported upon an upper free end of the rigid air supply tube and the case has a removable cover with an opening for the tube and a removable cap is provided as a closure for the opening in the cover.

8. The apparatus of claim 7 wherein the air supply tube extends vertically from the case through an opening in the cover and the tube can be disconnected from the blower for being stored beneath said cover within the case when not in use.

9. The apparatus of claim 7 wherein the air blower is connected to a manifold within the case, a pair of said air supply tubes is provided for being connected in communication with the manifold so as to extend upwardly therefrom when deployed to force a current of air through at least one article of clothing.

10. A portable and collapsible sports dryer for drying wearing apparel, comprising:

a dual purpose compartmented carrying case, said compartmented carrying case having, a) a tube storage plenum and b) a manifold therein for distributing air during operation to an article of wearing apparel, at least one air supply tube communicating during operation with the manifold and positioned to extend out of the carrying case for conveying air to an article of wearing apparel, and a blower for forcing air through the manifold into the air supply tube to dry said article of wearing apparel wherein the plenum is above the manifold within the case and the air supply tube is connected during operation to communicate with the manifold and extends while in use upwardly through the plenum and out through a top wall of the case for supplying air to an article of wearing apparel that is placed on top of said dryer.

11. The apparatus of claim 10 wherein two such air supply tubes are provided and each such tube includes at least two separable segments that are connected to each other during use and the segments are disconnected from one another for being placed in storage within the tube storage plenum.

12. The apparatus of claim 10 wherein the case has a horizontal dividing partition defining a top of the manifold, a pair of pipes extend upwardly from the partition through the plenum, the tubes when deployed are each mounted on one of the pipes such that when the tubes are deployed each tube extends through an opening in a top wall of the carrying case.

13. The apparatus of claim 10 wherein the carrying case has a hinged top wall which acts as a drip shield with a pair of openings and two of the air supply tubes are provided so that when the tubes are deployed each tube extends through one of the openings in the cover.

14. The apparatus of claim 10 wherein the air supply tube extends vertically from the blower during use and has a horizontally disposed shoe support duct extending laterally from an upper free end thereof when the tube is in a vertically disposed deployed position.

15. The apparatus of claim 10 wherein the blower includes an electric motor and an on/off switch wired to the motor is mounted in a wall of the carrying case for being operated from outside the case for turning the blower on to dry the wearing apparel.

16. The apparatus of claim 10 wherein the blower is suspended adjacent an opening in a partition within the case that forms a top wall of the manifold, there are two of said air supply tubes, and the air supply tubes are connected during operation to communicate through the partition with the manifold for receiving air from the blower so as to transfer air out of the carrying case to the article of wearing apparel.

17. A portable and collapsible sports dryer for drying wearing apparel, comprising:

at least one rigid air supply tube having an open end for being placed within a clothing article, an electric air blower communicating with the tube for circulating air to dry the clothing article, a removable drip shield is provided between an open end of the tube and the electric blower for deflecting moisture that drips from the wearing apparel away from the electric blower, a dual purpose compartmented carrying case that contains the blower, said compartmented carrying case having, a) a tube storage plenum and b) a manifold therein for distributing air during operation to an article of wearing apparel, the rigid air supply tube is sized to be stored within the case but is removable therefrom for being connected during use to the manifold so as to communicate with the blower, said tube being positioned while in operation to extend upwardly from the case for forcing a current of air through said article of wearing apparel when the article is supported upon an upper free end of the tube.

18. The apparatus of claim 17 wherein the blower communicates between the storage plenum and the manifold for blowing air from the storage plenum into the manifold and thence into the air supply tube.

19. The apparatus of claim 17 wherein two such air supply tubes are provided and each such tube includes at least two separable and storable segments that are connected to each other during use and the segments are disconnected from one another for being placed in storage within the tube storage plenum.

20. The apparatus of claim 17 wherein the case has a horizontal dividing partition therein defining the top of the manifold, a pair of pipes extend upwardly from the partition through the plenum, two such tubes are provided and-the tubes when deployed are each mounted on one of the pipes such that when the tubes are deployed each tube extends upwardly from the case through an opening in a top wall of the carrying case.

* * * * *